US007606526B2

(12) United States Patent
Patsiokas et al.

(10) Patent No.: US 7,606,526 B2
(45) Date of Patent: Oct. 20, 2009

(54) METHOD AND APPARATUS FOR PROVIDING DIGITAL MEDIA PLAYER WITH PORTABLE DIGITAL RADIO BROADCAST SYSTEM RECEIVER OR INTEGRATED ANTENNA AND DOCKING SYSTEM

(75) Inventors: Stelios M. Patsiokas, Coral Springs, FL (US); Paul D. Marko, Pembroke Pines, FL (US); Stuart Cox, Boca Raton, FL (US)

(73) Assignee: XM Satellite Radio Inc., Washington, DC (US)

( * ) Notice: Subject to any disclaimer, the term of this patent is extended or adjusted under 35 U.S.C. 154(b) by 525 days.

(21) Appl. No.: 11/239,642

(22) Filed: Sep. 30, 2005

(65) Prior Publication Data

US 2007/0077882 A1 Apr. 5, 2007

(51) Int. Cl.
*H04H 20/74* (2008.01)

(52) U.S. Cl. ..... 455/3.02

(58) Field of Classification Search ..... 455/3.02
See application file for complete search history.

(56) References Cited

U.S. PATENT DOCUMENTS

| | | | | |
|---|---|---|---|---|
| 5,721,827 | A | 2/1998 | Logan et al. | 395/200.47 |
| 5,822,737 | A | 10/1998 | Ogram | 705/26 |
| 5,892,536 | A | 4/1999 | Logan et al. | 348/13 |
| 5,963,917 | A | 10/1999 | Ogram | 705/26 |
| 5,986,692 | A | 11/1999 | Logan et al. | 348/13 |
| 6,088,455 | A | 7/2000 | Logan et al. | 380/200 |
| RE36,801 | E | 8/2000 | Logan et al. | 348/571 |
| 6,154,452 | A | 11/2000 | Marko et al. | 370/321 |
| 6,229,824 | B1 | 5/2001 | Marko | 370/477 |
| 6,233,389 | B1 | 5/2001 | Barton et al. | 386/46 |
| 6,381,584 | B1 | 4/2002 | Ogram | 705/26 |
| 6,510,317 | B1 | 1/2003 | Marko et al. | 455/428 |
| 6,553,077 | B2 | 4/2003 | Rindsberg et al. | 375/260 |
| 6,564,003 | B2 * | 5/2003 | Marko et al. | 386/69 |
| 6,608,399 | B2 | 8/2003 | McConnell et al. | 307/10.1 |
| 6,628,928 | B1 | 9/2003 | Crosby et al. | |
| 6,629,197 | B1 * | 9/2003 | Bhogal et al. | 711/111 |
| 6,631,271 | B1 | 10/2003 | Logan | 455/456 |
| 6,665,659 | B1 | 12/2003 | Logan | 707/3 |
| 6,678,215 | B1 | 1/2004 | Treyz et al. | 368/10 |
| 6,681,176 | B2 | 1/2004 | Funk et al. | 701/207 |
| 6,697,944 | B1 | 2/2004 | Jones et al. | 713/168 |
| 6,904,264 | B1 * | 6/2005 | Frantz | 455/3.04 |
| 2002/0132575 | A1 | 9/2002 | Kesling et al. | |
| 2002/0163780 | A1 * | 11/2002 | Christopher | 361/686 |
| 2003/0014767 | A1 | 1/2003 | Stumphauzer, II | 725/131 |
| 2003/0093790 | A1 | 5/2003 | Logan et al. | |
| 2003/0110057 | A1 * | 6/2003 | Pisz | 705/1 |
| 2003/0135464 | A1 | 7/2003 | Mourad et al. | |
| 2004/0058641 | A1 * | 3/2004 | Acker | 455/3.02 |

(Continued)

*Primary Examiner*—Matthew D Anderson
*Assistant Examiner*—Bobbak Safaipour
(74) *Attorney, Agent, or Firm*—Roylance, Abrams, Berdo & Goodman, LLP

(57) ABSTRACT

A portable media player for receiving and storing a satellite digital audio radio service (SDARS) content stream is provided. Also provided are associated devices such as an integrated antenna and docking station, an SDARS receiver module for detachable connection to a player, digital transceiver circuits for connecting an SDARS receiver to various SDARS-ready devices, an SDARS digital antenna, and an SDARS subscription cartridge, as well as methods for operating same.

29 Claims, 14 Drawing Sheets

U.S. PATENT DOCUMENTS

2005/0049002 A1* 3/2005 White et al. ..... 455/556.1
2005/0086124 A1* 4/2005 Godoy et al. ..... 705/26
2006/0094349 A1* 5/2006 Slesak et al. ..... 455/3.02
2007/0015486 A1* 1/2007 Marlowe ..... 455/345
2008/0118079 A1* 5/2008 Marlowe ..... 381/77
2008/0130912 A1* 6/2008 Marlowe ..... 381/86
2009/0017866 A1* 1/2009 White et al. ..... 455/556.1

* cited by examiner

METHOD AND APPARATUS FOR PROVIDING DIGITAL MEDIA PLAYER WITH PORTABLE DIGITAL RADIO BROADCAST SYSTEM RECEIVER OR INTEGRATED ANTENNA AND DOCKING SYSTEM

CROSS REFERENCE TO RELATED APPLICATION

Related subject matter is disclosed and claimed in co-pending U.S. patent application Ser. No. 10/831,343, filed Apr. 26, 2004; the entire contents of which is hereby incorporated herein by reference.

FIELD OF THE INVENTION

The present invention relates generally to portable media players for receiving and storing a satellite digital audio radio service (SDARS) content stream, associated devices such as an integrated antenna and docking station, an SDARS receiver module for detachable connection to a player, digital transceiver circuits, a digital antenna, and an SDARS subscription cartridge, and to methods for operating same.

BACKGROUND OF THE INVENTION

Handheld or portable digital media players have been developed that enable a user to receive and store content from a satellite digital audio radio service (SDARS) content stream. The SDARS content stream can comprise video and data such as still images, text, binaries and so on, as well as audio content. These portable digital media players generally include an integrated battery, satellite receiver and antenna, a memory device for storing content from the SDARS content stream, a user input device such as a keypad, a display and a programmed functionality which allows the user to use data provided within the SDARS content stream (e.g., channel number, song title, artist, and so on) to select channels in the content stream from which to record content and to navigate within the stored content. These portable digital media players, however, consume significant power and require relatively large batteries. A need exists for a digital media player for storing SDARS content and allowing navigation and playback of same having a reduced form factor.

Further, the users of these portable players are can be subject to the inconvenience of not having reception of SDARS content due to the player being physically disposed from a strong SDARS signal or due to lack of battery power. A need therefore also exists to support robust, on-demand capture of SDARS content for playback on the digital media player, regardless of the physical location of the player.

In addition, subscriptions for SDARS must typically be purchased for each SDARS receiver unit a user employs. Although many SDARS receiver units are provided with multiple kits (e.g., home and/or auto kits), some SDARS receivers may not be provided with a desired configuration (e.g., portability, docking, user interface options), necessitating the purchase of another type of SDARS receiver unit (e.g., such as a portable media player having an SDARS receiver) with the desired configuration, as well as the expense of another subscription. A need therefore exists for a more versatile SDARS receiver unit that allows the user to employ the unit and corresponding subscription at different locations and in different configurations.

SUMMARY OF THE INVENTION

In accordance with an exemplary embodiment of the present invention, a portable media player is provided comprising: an interface to an SDARS reception device to allow communication between the media player and the SDARS reception device; a user interface for selecting among a plurality of SDARS channels received via the SDARS reception device; a controller; and a memory device. The controller is programmable to send control signals to the SDARS reception device, when the SDARS reception device is connected to the media player via the interface, and to command the SDARS reception device to send selected ones of the plurality of SDARS channels for storage in the memory device. The controller is programmable to playback selected ones of the plurality of SDARS channels from the memory device when the SDARS reception device is not connected to the media player.

In accordance with another exemplary embodiment of the present invention, an SDARS receiver and digital media player system is provided comprising: a portable digital media player having a first communication interface, a memory device, a controller, a user interface and a first connector; and a portable SDARS receiver module having a second connector configured to detachably and electrically connect to the player via the first connector, an antenna, an SDARS tuner and a baseband processing device for receiving an SDARS signal and recovering program channels therefrom, and a second communication interface. When the player and the SDARS receiver module are connected together, the player and the SDARS receiver module transmit and receive signals between each other via the first communication interface and the second communication interface, the signals comprising at least one of control signals and at least part of the SDARS signal. The control signals comprise signals from the portable digital media player to select from among the program channels that are transmitted to the SDARS receiver module in response to user input signals from the user interface, and the at least part of the SDARS signal comprises the selected program channels recovered by the SDARS receiver module and transmitted to that player. The controller is operable to store at least the selected program channels in the memory device for playback via the player when the player is not connected to the SDARS receiver module and when the antenna is not able to receive the SDARS signal, and the controller is operable to playback the SDARS signal as it is being received via the SDARS receiver module when the player is connected to the SDARS receiver module.

In accordance with another exemplary embodiment of the present invention, an SDARS receiver system is provided comprising: a docking station comprising a player interface configured to detachably connect a portable digital media player to the docking station, the portable digital media player having a first transceiver interface; an integrated SDARS antenna connected to the docking station, the integrated SDARS antenna comprising an antenna, an SDARS tuner and baseband processing device for receiving an SDARS signal and recovering program channels therefrom, and a second transceiver interface; and a conductor electrically connecting the docking station and the integrated SDARS antenna via the first transceiver interface and the, second transceiver interface, respectively. The control signals from the portable digital media player to select from among the program channels are provided to the integrated SDARS antenna via the conductor, and the selected program channels recovered by the integrated SDARS antenna are provided to the portable digital media player via the conductor.

In accordance with another exemplary embodiment of the present invention, the first transceiver interface and the second transceiver interface are configured to perform bidirectional, multiplexed communication via the conductor. The conductor is a serial bus and can employ two-wire differential communications. The transceiver interfaces can comprise TDM TDD bus multiplexers to implement multiplexed communications on the conductor.

In accordance with another exemplary embodiment of the present invention, the docking station is connected to a power source and configured to provide power to the conductor. The conductor can further comprise two power lines to supply power to the integrated SDARS antenna from the docking station.

In accordance with another exemplary embodiment of the present invention, a digital antenna module for providing SDARS to an SDARS-compatible playback device is provided which comprises: an antenna for receiving an SDARS signal; an SDARS receiver module comprising an SDARS tuner and a baseband processing device for processing the SDARS signal and recovering program channels therefrom; and a communication interface for connecting to the SDARS-compatible playback device, the SDARS-compatible playback device having a corresponding communication interface. When the digital antenna module and the SDARS-compatible playback device are connected together, the digital antenna module and the SDARS-compatible playback device transmit and receive signals between each other via their respective communication interfaces, the signals comprising at least one of control signals and at least part of the SDARS signal. The control signals comprise signals from the SDARS-compatible playback device to select from among the program channels that are transmitted to the digital antenna module in response to user input signals provided to the SDARS-compatible playback device, and the at least part of the SDARS signal comprises the selected program channels recovered by the digital antenna module and transmitted to the SDARS-compatible playback device.

BRIEF DESCRIPTION OF THE DRAWINGS

These and other aspects, advantages and novel features of the present invention will be readily comprehended from the following detailed description when read in conjunction with the accompanying drawings.

Throughout the drawing figures, like reference numerals will be understood to refer to like parts and components.

DETAILED DESCRIPTION OF THE PREFERRED EMBODIMENTS

Figure 1A:
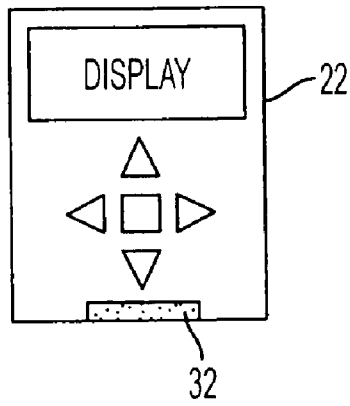
FIGS. 1A, 1B and 1C depict an integrated antenna and docking system configured for use with a digital media player in accordance with an embodiment of the present invention.
Figure 1B:
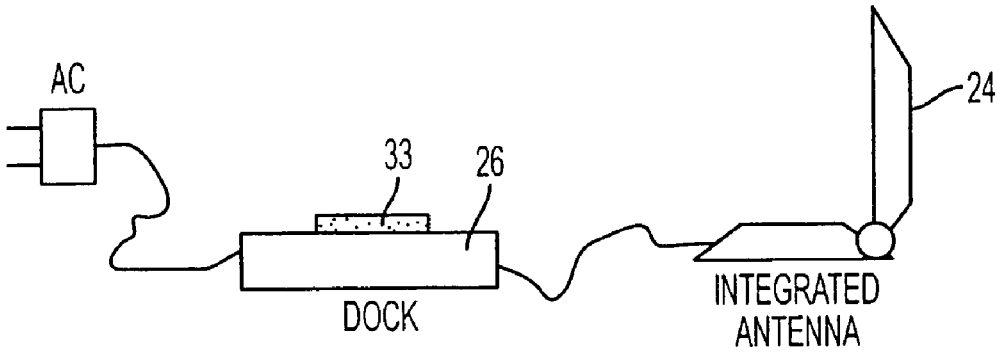
Figure 1C:
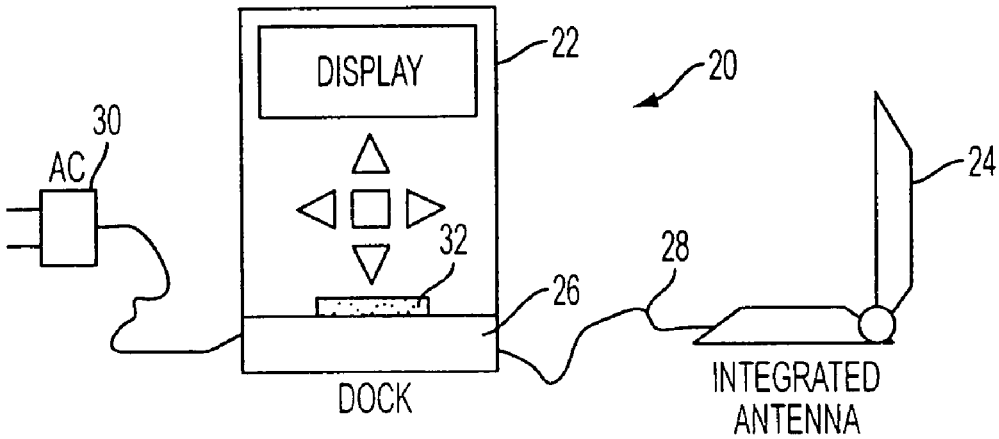

In accordance with exemplary embodiments of the present invention, digital player and SDARS receiver systems are disclosed which achieve a reduced form factor for the digital media player, improved battery performance, and robust capture of SDARS content independent of the digital media player presence in a strong SDAR signal In accordance with an exemplary embodiment of the present invention, an integrated antenna and docking system 20 is provided which comprises an integrated antenna module 24 and, a docking station 26 (FIG. 1B) that can be connected to a digital media player 22 (FIG. 1A), as shown in FIG. 1C. As described in more detail below in connection with FIG. 1B, the integrated antenna module 24 comprises an SDARS receiver and antenna and an interface to a cable 28 for communications and control between the integrated antenna module 24 and the docking station 26 configured to accommodate a digital media player 22. The communications cable 28 preferably comprises four wires, with preferably two wires for supplying power (such as DC power and ground) from the docking station to the integrated antenna module 24, and two wires providing bidirectional communication between the integrated antenna module 24 and the docking station 26 (and in turn to a digital media player 22 connected to the docking station 26). Of course, it should be understood that the communication cable 28 from the integrated antenna module 24 to the docking station 26 can comprise other combinations of cable or conductors. For example, the cable 28 may comprise fewer conductors and only provide communication in one direction.

The integrated antenna and docking system 20 in FIG. 1C enables a user to plug a digital media player 22 into the docking station 26 and control (i.e., via the media player user interface) the SDARS receiver in the integrated antenna module 24 to playback live content from a received SDARS content stream, as well as to obtain a compressed stream via the four-wire cable for storage in the digital media player 22. The digital media player 22 can then be detached from the docking station 26 and carried by a user for playback purposes without an SDARS receiver therein. Accordingly, the digital media player 22 can be designed with a reduced form factor since it does not require an SDARS receiver, an antenna, or large battery having the capacity needed to operate the receiver since mere playback of stored content consumes less power than reception of it. An exemplary integrated antenna module 24 is described below in connection with FIG. 2. An exemplary docking station 26 is described below in connection with FIG. 3. An exemplary digital media player 22 is described below in connection with FIG. 5.

Figure 2:
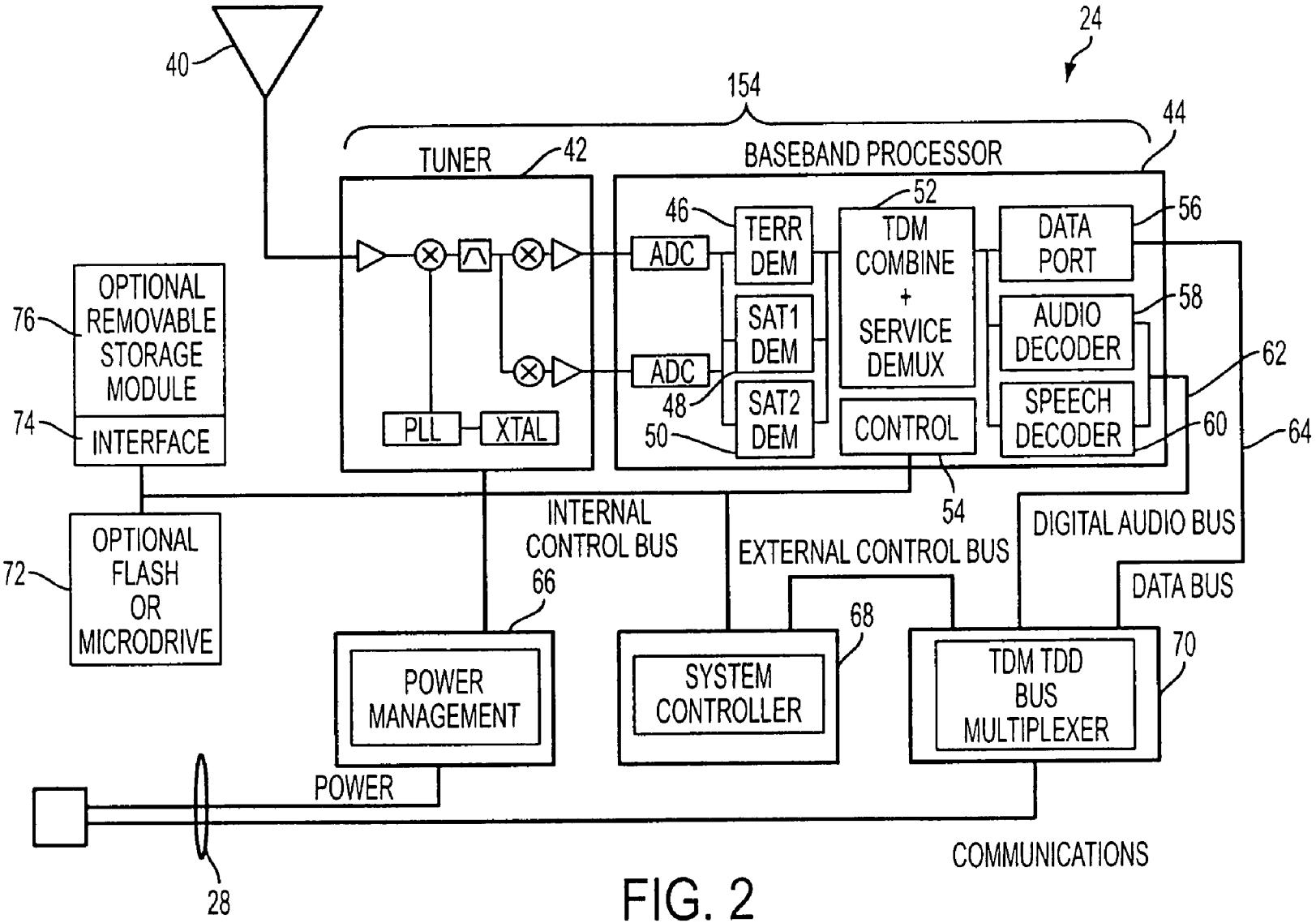
FIG. 2 is a block diagram of an integrated antenna module for use with the integrated antenna and docking system of FIG. 1.

A block diagram of an exemplary integrated antenna module 24 is provided in FIG. 2. The integrated antenna module 24 preferably comprises an antenna 40 for receiving an SDARS signal, a tuner 42, a baseband processor 44, a system controller 68, and an interface 70 such as a time division multiplexing, time division duplexing (TDM TDD) bus multiplexer for interfacing the baseband processor 44 to the cable 28. As stated above, the cable 28 preferably comprises two wires for power (such as line power and ground wires) and two wires for supporting two-wire differential communications. Baseband processor 44 is illustrated as being connected to a TDM TDD bus multiplexer 70 via a data bus 64 and a digital audio bus 62. It is to be understood, however, that separate or discrete lines can be used to connect the baseband processor to the docking station via a cable.

With continued reference to FIG. 2, the digital audio bus 62 preferably transports uncompressed audio. The digital audio bus 62 can transport, for example, an $i^2S$ formatted signal which is known in the industry. The data bus 64 can be used for the output of non-audio or compressed audio signals. The system controller 68 of the integrated antenna module 24 receives commands from the digital media player 22 via the communication cable 28, allowing the digital media player 22 to control the SDARS receiver 154 (i.e., the tuner 42 and baseband processor 44) in the integrated antenna module 24 when the player 22 is connected to the docking station 26. Thus, for example, the user can use controls on the digital media player 22 to tune to different SDARS stations. Commands are passed from the digital media player 22 to the system controller 68 in FIG. 2 via an external control bus (e.g., the two-wire differential communication link in the cable 28), which is multiplexed on the communication cable 28 via the TDM TDD bus multiplexer 70. The external control bus (e.g., see bus 166 in FIG. 7) preferably supports two-way communications via transmit and receive UART lines, which enable a command and response communications protocol. The system controller 68 receives the commands and in turn controls the receiver 154. Data is also preferably transmitted to the digital media player 22 via the TDM TDD Bus 166. The data includes, for example, compressed audio data and ancillary data. The ancillary data comprises, for example, updated stock quotes, sports scores, weather information, traffic information, news, firmware updates, compressed still images, compressed video, or the artist name and song title to be displayed on the digital media player. Further details of exemplary two-way communications are provided below.

With further reference to FIG. 2, the SDARS receiver 154 in the integrated antenna module 24 preferably comprises three receiver arms for processing the SDARS broadcast stream received from two satellites and a terrestrial repeater, as indicated by the demodulators 46, 48 and 50, that are demodulated, combined, decoded and demultiplexed to recover channels from the SDARS broadcast stream, as indicated by the controller 54 and TDM combine and service demultiplexer module 52. Demultiplexed data from the SDARS broadcast stream is provided to a data port 56 and the data bus 64. Demultiplexed audio, speech and the like are provided to audio and speech decoders 58 and 60 having outputs to the digital audio bus 62. Processing of a received SDARS broadcast stream is described in further detail in commonly owned U.S. Pat. Nos. 6,154,452 and 6,229,824, the entire contents of which are hereby incorporated herein by reference. The integrated antenna module 24 further comprises a power management device 66 for receiving power from the docking station 22 via the cable 28 and providing power to the components in the integrated antenna module 24.

The integrated antenna and docking system 20 can optionally contain FLASH or a microdrive memory device 72 (e.g., in the integrated antenna module as shown in FIG. 2) for storing a compressed stream when the player 22 is not in the docking station 26. In this configuration, the player 22 or a separate user interface on the docking station 26 instructs the system controller in the integrated antenna module (FIG. 2) as to which compressed audio streams to store in memory. This enables storage of content to continue while the player 22 is removed from the docking station 26. When the player 22 is then attached to the docking station 26, transfer of the stored content from the docking station memory device 94 to the player memory 126 (i.e., from the FLASH or a microdrive memory device 72 in the integrated antenna module to the docking station memory 94 and then, in turn, to the player memory 126 via the player interface 32 and connector 33), or directly from the FLASH or a microdrive memory device 72 in the integrated antenna module to the player memory 126, can occur substantially faster than recording the real-time streams. Moreover, robust recording can continue at the integrated antenna module 24 even if the player 22 is in a situation where robust SDARS reception is impractical.

The integrated antenna and docking system 20 can optionally incorporate a removable storage module 76 and corresponding interface 74 such as removable flash media or a removable hard drive or microdrive component for storing a compressed multimedia data stream when the player 22 is not in the docking station 26. As described below in connection with FIG. 5, the player 22 also incorporates the interface 74' required to receive the same removable storage module 76 and process the content directly from the inserted removable storage module 76 or copy the content from the removable storage module 76 to the player's embedded storage device or to the flash or microdrive126. This enables capture and storage of SDARS content to continue at the integrated antenna and docking system 20 without the player 22 being connected to the docking station 26. It also enables the convenience of transferring of the content from the docking station 26 to the player 22 through use of the removable storage module 76, without requiring the player 22 to be physically connected or even located near the docking station 26. Moreover, with the use of multiple storage modules 76, additional content can be recorded and stored by the integrated antenna and docking system 20 with storage module "A" at the same time the user is enjoying previously stored content in storage module "B" in the player 22 device while away from the integrated antenna and docking system 20. In this alternate implementation involving the removable storage module 76 for content transfer, there is never a need for the player 22 to be physically connected to the docking station 26 if the player 22 has its own battery and charger/power management device with connection to an external power source, and so the interface connections between player and docking station can be omitted with resultant cost and size advantages.

Figure 3:
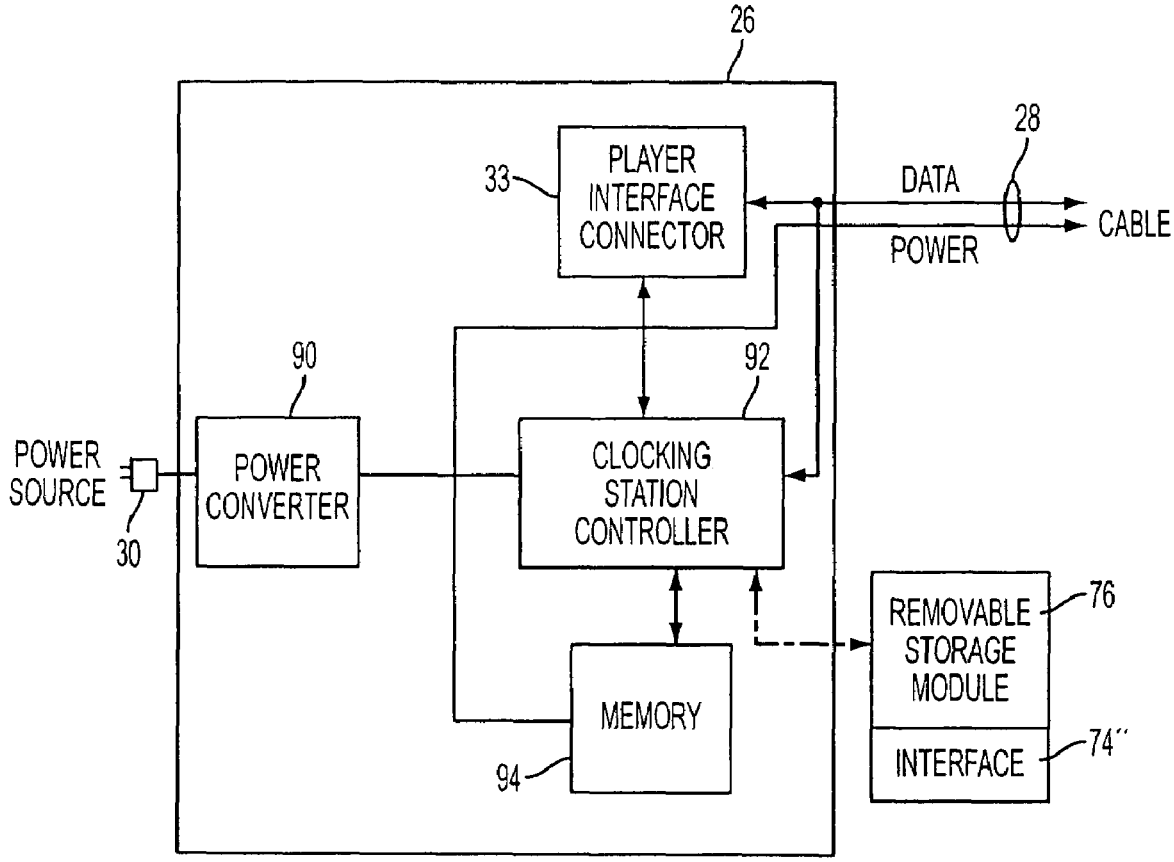
FIG. 3 is a block diagram of a docking station for use with the integrated antenna and docking system of FIG. 1.

In the alternate exemplary implementation of the invention involving a removable storage module 76 for content transfer, the docking station has an optional interface 74", as shown in FIG. 3. The selection of the user's desired content recording parameters, for example, time of day and channels to record, can be established using the user interface of the player 22 while it is not connected to the docking station 26. These recording parameters are then written to the removable storage module 76 presently connected to the player 22 via the interface 74'. Later, when the user removes this storage module 76 from the player 22 and inserts it in the docking station interface 74", the docking station controller 92 transfers the recording parameters from the removable storage 76 to its memory 94 and uses these parameters to guide selection of SDARS content from the integrated antenna module 24 for recording and storing to the removable storage module 76. This approach further simplifies and reduces the cost of the docking station 26 by eliminating some user interface requirements on the docking station (e.g., the player interface connector 33 can be simply a cable 28 interface such as a four prong or socket connector 180 described below and not have other pin input/outputs to the player 22 for power and user interface control signals), and improves user convenience by allowing the user to make content recording selections while away from the integrated antenna and docking system 20.

The integrated antenna and docking system 20 can optionally translate the compressed content recorded from the SDARS system into a different compressed or uncompressed format required by the player for content playback or rendering. This can further reduce cost, power, and size requirements imposed on the player by eliminating the need to augment the player with decoding hardware and/or software necessary to decode the content in the original compressed form used by the SDARS system. Furthermore, the integrated antenna and docking system 20 can encrypt the content before it is transferred to the player or to a removable storage module to insure the protection of copyrighted content, allowing use of low-cost, industry standard decoders and digital rights management schemes within the digital media player.

Figure 7:
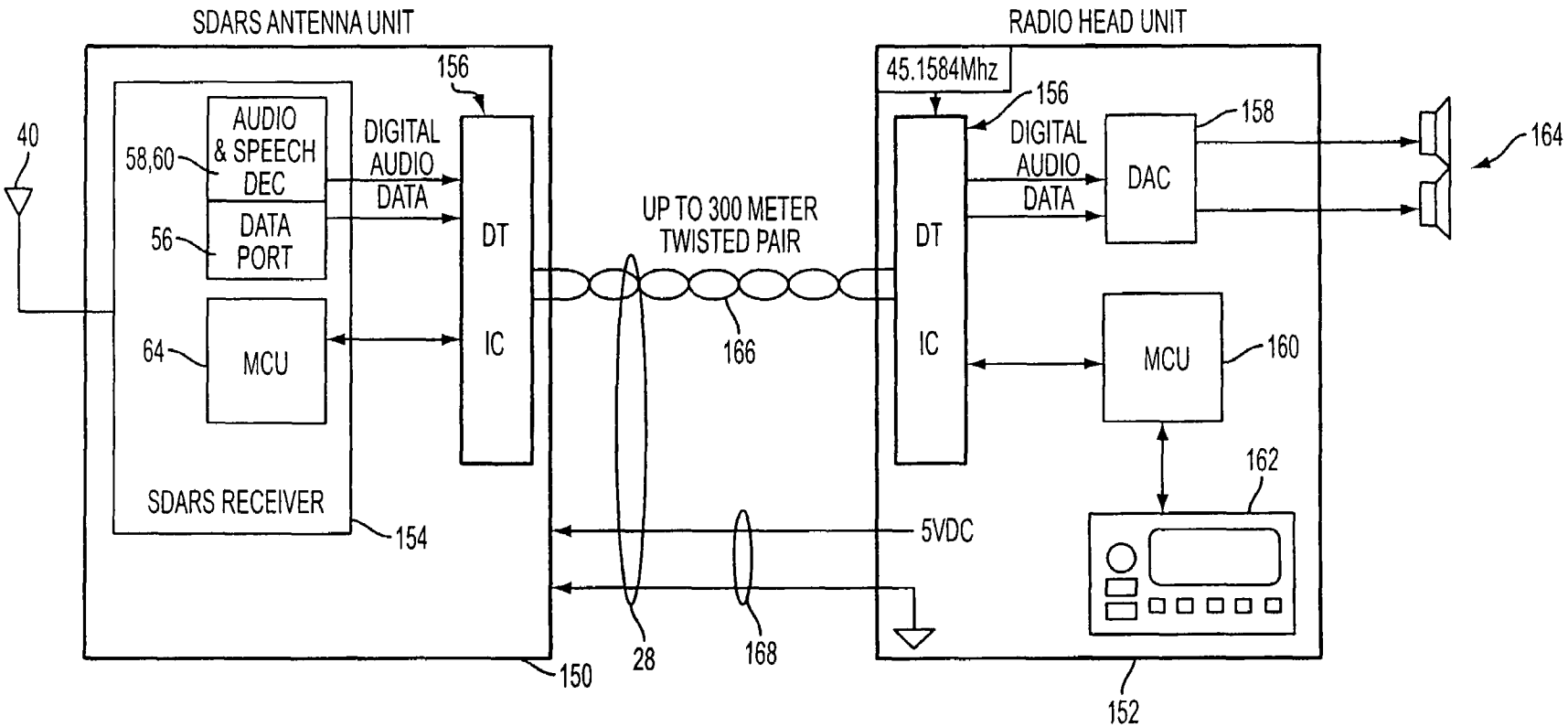
FIG. 7 depicts a digital transceiver circuit in accordance with an embodiment of the present invention deployed in an SDARS receiver and in consumer equipment (e.g., a radio head unit) to facilitate communication therebetween.

As stated above, the exemplary docking station 26 illustrated in FIG. 3 comprises a controller 92 and memory 94. The docking station can be connected to an external power source 30 and has a power converter to provide power to its components, as well as to the integrated antenna module 24 via preferably two power lines in the cable 28 described above. The player interface connector 33 is configured to receive the selected program channels either directly from the cable 28 (e.g., from the two-wire communication lines 166 as shown in FIG. 7) or from the controller 92 which is connected to the communication lines 166.

Figure 4A:
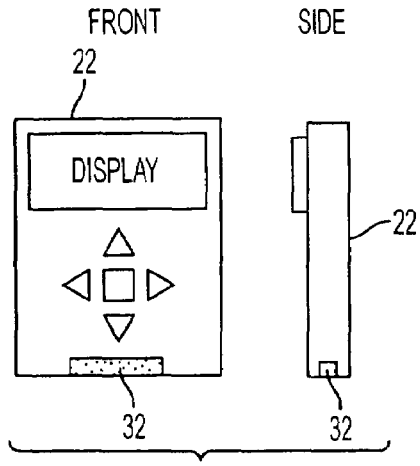
FIGS. 4A, 4B and 4C depict a portable and detachable digital media player and SDARS receiver system in accordance with an embodiment of the present invention.
Figure 4B:
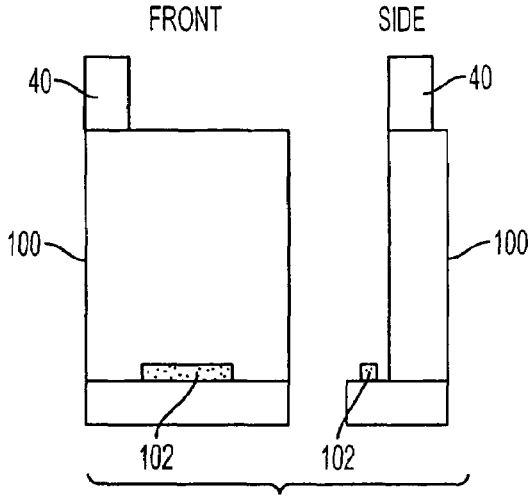
Figure 4C:
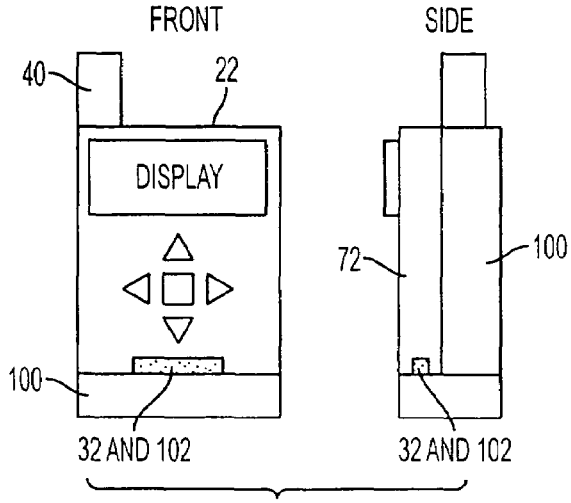
Figure 5:
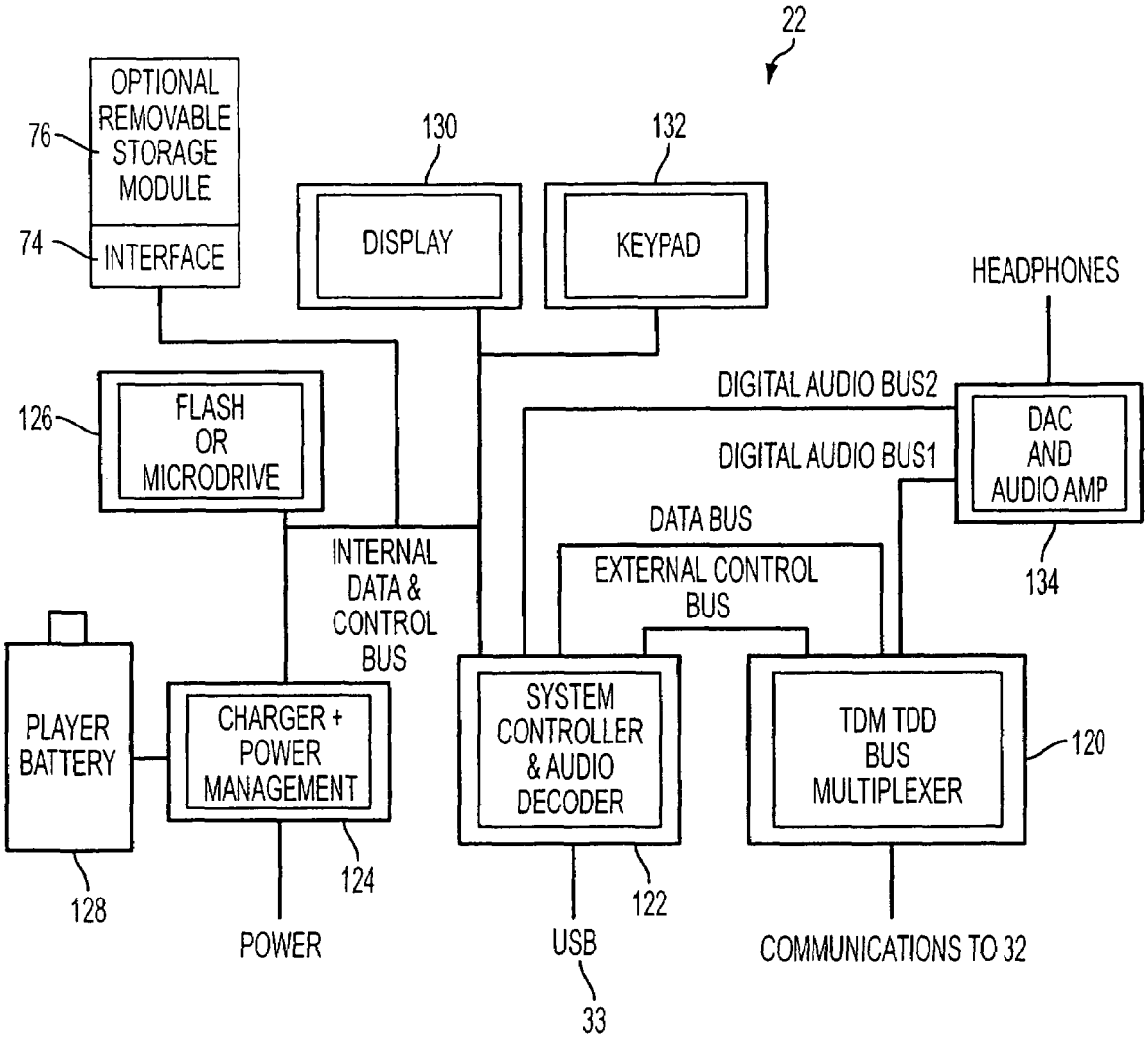
FIG. 5 is a block diagram of a player module for use with the portable and detachable digital media player and SDARS receiver system of FIG. 4.
Figure 6:
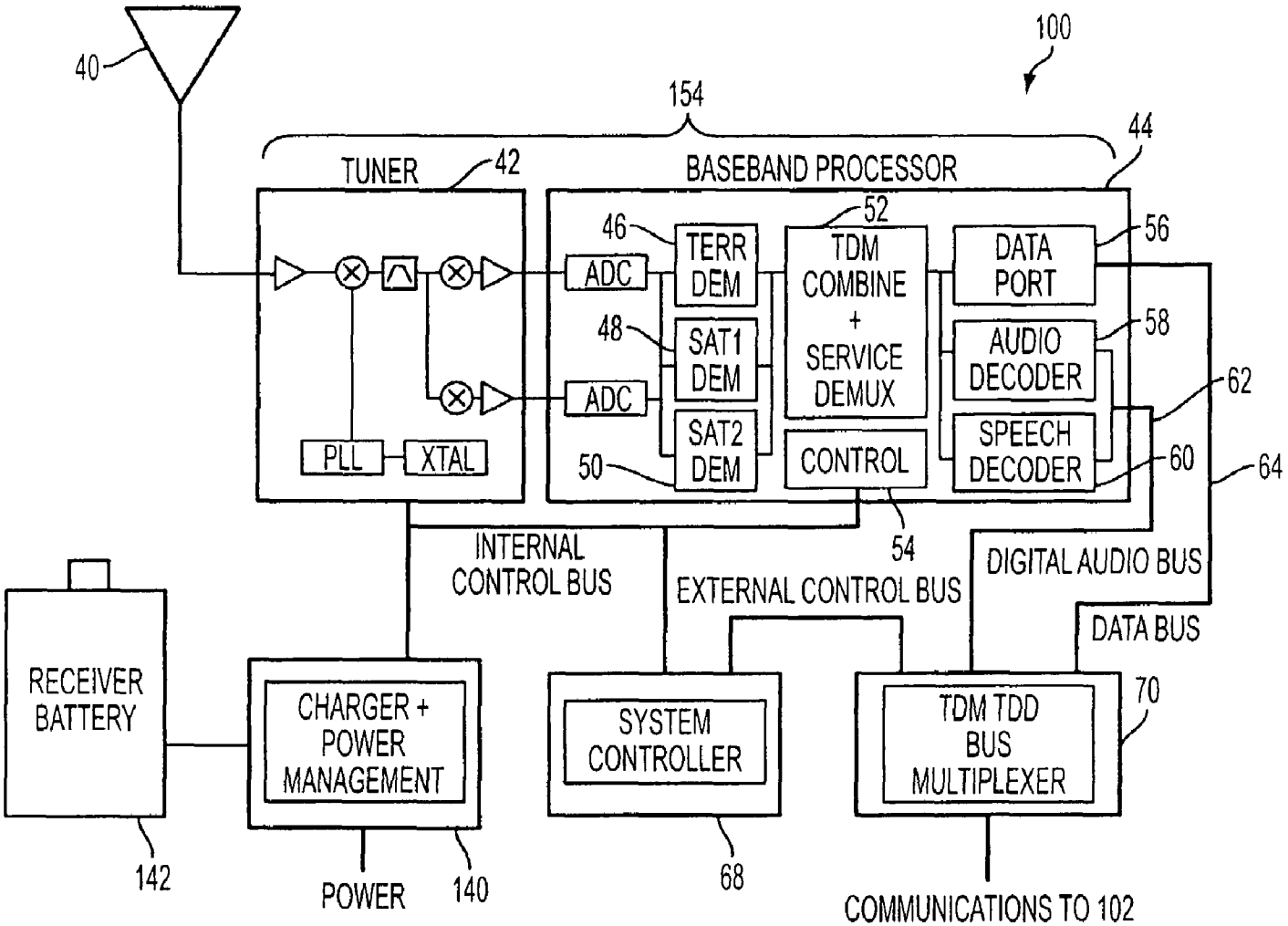
FIG. 6 is a block diagram of a receiver module for use with the portable and detachable digital media player and SDARS receiver system of FIG. 4.

In accordance with another embodiment of the present invention, a digital media player 22 is connected to a portable receiver module 100 as illustrated in FIGS. 4A, 4B and 4C. The components of the player module 22 and the receiver module 100 are illustrated in FIGS. 5 and 6, respectively. The player module 22 comprises a display 130, keypad 132, and a memory device 126 such as a flash or micro drive for storing selected content. The player module 22 also comprises a battery 128 and charger/power management device 124, a system controller and audio decoder 122, a digital analog converter and audio amplifier module 134, a bus multiplexer 120 (such as a TDM TDD bus multiplexer) or other interface from the player module 22 to the corresponding interface in the receiver module 100. In the illustrated embodiment, the player 22 has player interface 32, and the receiver module 100 has a corresponding connector 102 adapted to mate with the player interface 32 to electrically connect the two devices 22 and 100. The player 22 can also be connected to a personal computer (PC) via a USB as indicated at 33. The player 22 can therefore be operated with a PC to manage playlists of content stored from the received SDARS stream, as well as other content files, and to otherwise search and navigate among stored content.

With reference to FIG. 6, the receiver module 100 is similar to the integrated antenna module 24 in FIG. 2; however, the receiver module 100 further comprises a receiver battery 142 and charger and power manager device 140. In accordance with an aspect of the present invention, the receiver module 100 has a battery, and the player 22 preferably has a miniaturized battery to allow for a reduced form factor thereof. The digital player and receiver system depicted in FIGS. 4A, 4B and 4C is advantageous in that the antenna 40, the tuner 42, the baseband processor 44, the battery system 140,142 and the receiver system controller 68 are provided in a module 100 that attaches to the player 22 to allow the player's user interface to control the receiver module 100 for live listening through the player 22 and for storage of live content when the player 22 and receiver 100 combination are being operated in a coverage area of SDARS system. Thus, when the player and receiver modules 22 and 100 are connected, a user is provided with a portable system capable of receiving and playing live SDARS content. The larger battery supplied in the receiver module 100 is capable of driving the receiver components and the antenna. The player. 22, however, can be detached from the receiver module 100 and is more portable since the player 22 need not enclose the antenna 40, the SDARS receiver 154, or receiver battery and charger and power management modules 140 and 142. In other words, the player battery 128 provided in the player 22 can be smaller, and the player 22 has fewer components. The system controller 68 illustrated in FIG. 6 responds to player commands via the TDM TDD multiplexer 70 and also provides data such as artist name and song titles to the player 22. The data can also include other information such as personalized traffic, weather and stock information provided via the data bus.

The modular approach to the receiver module 100 is advantageous in that receiver modules can be designed as add-ons to many types of digital media players, including existing MP3 players. The interface provided by the TDM TDD bus 166 and the system controller 68 enable the receiver module 100 to receive commands and be controlled from an external player 22 when the player is connected, and also to provide SDARS content to an external player 22. Also, the player modules 22 can advantageously be made into a small form factor, since they do not require the antenna 40, receiver 154 or a large battery 142. The user then has the option of carrying a small lightweight player device 22 which can playback SDARS content which has been stored in the player 22, or combine the player 22 with the receiver module 100 for the ability to receive live SDARS content in a portable device.

The receiver modules 24 and 100 can optionally translate the compressed content recorded from the SDARS system into a different compressed or uncompressed format required by the player for content playback or rendering. This can further reduce cost, power, and size requirements imposed on the player 22 by eliminating the need to augment the player 22 with decoding hardware and/or software necessary to decode the content in the original compressed form used by the SDARS system. Furthermore, the receiver module 24, 100 can encrypt the content before it is transferred to the player 22 to insure the protection of copyrighted content, allowing use of low-cost, industry standard decoders and digital rights management schemes within the player 22.

Charging the batteries of the system depicted in FIGS. 4A, 4B and 4C normally requires a separate charger for the player battery 128 and the receiver module battery 142. In order to eliminate the requirement for two supply voltages for charging the separate batteries when the player 22 is mated to the receiver module 100, common power supply lines are provided in the interface connector to allow the charge supply voltage to supply both battery chargers, such that both batteries may be charged simultaneously from a single external power supply.

As stated above, a modular approach to the SDARS receiver module is advantageous in that the SDARS receiver module can be designed as an add-on to different media players. An illustrative embodiment of an interface that enables a digital broadcast system receiver such as an SDARS receiver module to receive commands and be controlled from an external media player will now be described with reference to FIG. 7. The interface is preferably implemented using a digital transceiver integrated circuit (DTIC) 156 provided in each of at least two devices that are connected via a link to control communications on the link. Thus, the DTIC 156 provides a cost effective means for an electronics equipment manufacturer to be SDARS-compatible since the manufacturer can provide a DTIC in a media player or other consumer electronic device 152, and another DTIC in a corresponding SDARS receiver module 150 that is preferably detachable from the media player 152, to allow the media player 152 and the SDARS receiver module 150 to communicate with each other via the link. The receiver module 150 comprises an SDARS receiver 154 described above with reference to FIG. 2. Accordingly, some of the components are not depicted and described with respect to FIG. 7 for conciseness. The media player 152 comprises a user interface 162, a controller 160 and a digital-to-analog converter (DAC) 158 to provide recovered audio content from the SDARS broadcast stream to an output device 164.

The manufacturer preferably configures the DTIC 156 in the media player 152 to operate as a master device with respect to the DTIC 156 in the corresponding SDARS receiver module 150 since the media player 152 typically has a user interface 162 and controller 160. Accordingly, the DTIC 156 in the SDARS receiver module 150 is preferably, configured to operate as a slave device. The two DTICs 156 each multiplex data and audio streams (e.g., from an SDARS content stream) that are transported between the media player 152 and the SDARS receiver module 150 into a time division duplex (TDD) high frequency serial link that is preferably implemented as an EIA-422/484 physical interface. By way of an example, the DTIC 156 can implement a TDM TDD bus multiplexer 70. It is to be understood that a DTIC 156 can be provided in a number of different types of consumer equipment 152 to transport broadcast content streams from a digital broadcast system receiver 154 and to control the receiver 154 via a user interface 162 and controller 160 associated with the consumer equipment 152. By way of an example, the digital content stream receiver 150 can be the SDARS receiver module 100 depicted in FIG. 6. A user interface controller in consumer equipment can be a player module 22 as depicted in FIG. 5. The link can be implemented using a standard other than a TDD serial link or EIA-422/484 physical interface.

In an exemplary application, two devices (e.g., a receiver module 150 and a player module 152) comprising respective DTICs 156 connect to each other via a differential link as depicted in FIG. 7. On the slave side 150, the DTIC 156 can interface directly to an SDARS radio receiver device 154 (e.g., a radio receiver device comprising a tuner and a baseband processor, among other components) that receives a real-time PCM audio stream, along with data information. The SDARS radio receiver device 154 is illustrated, by way of an example, as a chip set employed by XM Satellite Radio, Inc. The receiver module 150 stores this data in an internal SRAM or other memory (not shown) and then time division multiplexes the data on a two-wire serial communication link 166. This link 166 preferably follows the EIA-422/485 standard and provides for the physical decoupling of the slave and master sides by as many as 100 meters. On the master side 152, the DTIC 156 in the consumer equipment de-multiplexes the communications data, stores it in RAM or other memory (not shown) and reproduces it for consumption. It is to be understood that each DTIC 156 is preferably capable of simultaneously sending and receiving serial frames, while multiplexing and de-multiplexing them in real-time, formatting them and then routing them into the appropriate slave or master side interfaces.

Figure 8A:
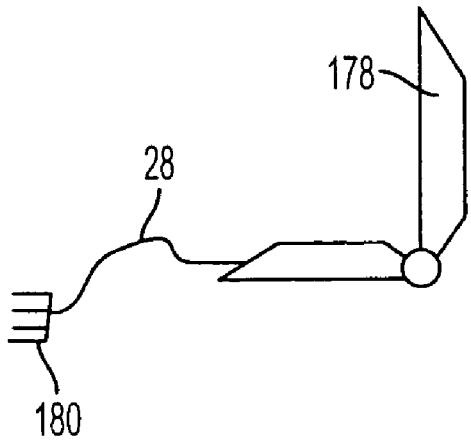
FIGS. 8A and 8B depict a digital antenna and connection to SDARS-compatible consumer equipment in accordance with an embodiment of the present invention.
Figure 8B:
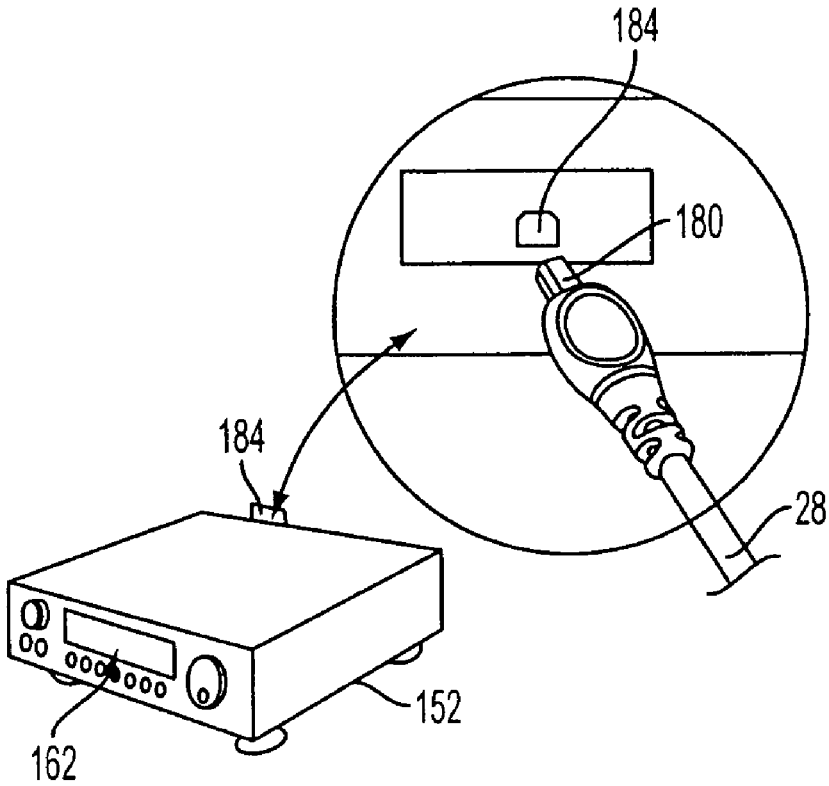

In accordance with another embodiment of the present invention, a digital antenna 178 is provided as illustrated in FIGS. 8A and 8B. The digital antenna 178 is preferably an SDARS receiver 154 and antenna 40 in one unit having a cable 28 as described above. The digital antenna 178 preferable has a four prong or socket connector 180 for electrical coupling with a connector 184 on another device 152. More specifically, the digital antenna 178 can be connected to a home or portable audio product (e.g., a home theater, stereo receiver, and the like) 152 that is SDARS or satellite radio-compatible, that is, that has an interface connecter 184 and master DTIC 156 for electrical connection to the cable 28 and a slave DTIC 156 implementing, for example, the TDM TDD bus multiplexer 70 in the digital antenna 156, as well as software to receive the SDARS signal from the digital antenna 178 and allow navigation and channel selection of channels in the SDARS signal for playback via the home or portable audio product.

Figure 9:
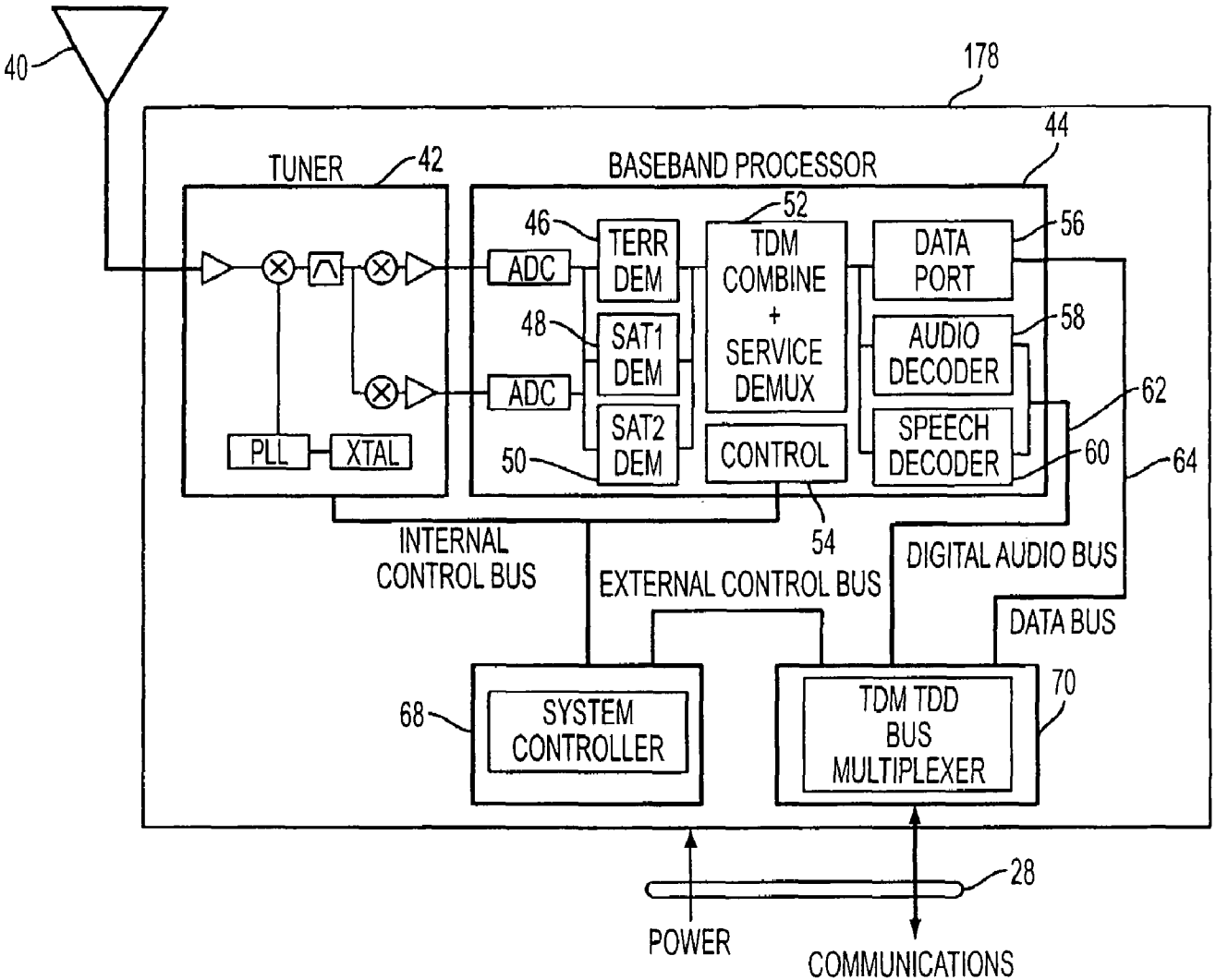
FIG. 9 is a block diagram of the digital antenna of FIG. 8.

With reference to FIG. 9, the digital antenna 178 preferably comprises essentially all of the components described above in connection with FIG. 6, except for the battery 142 and the charger and power management device 140. The description of the remaining components is therefore omitted here for conciseness. The digital antenna 178 can receive power from the satellite radio-compatible 156 via the cable 28. Alternatively, the digital antenna 178 can be provided with battery power and/or connection to an external power source.

Figure 10A:
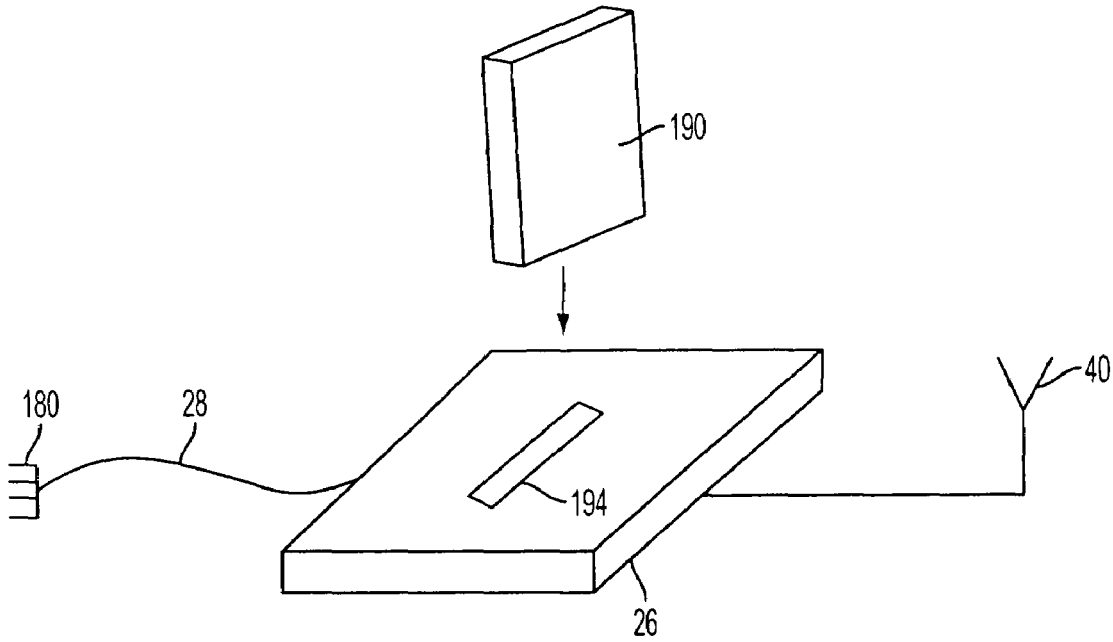
FIGS. 10A and 10B depict a docking system with SDARS subscription cartridge in accordance with an embodiment of the present invention.
Figure 10B:
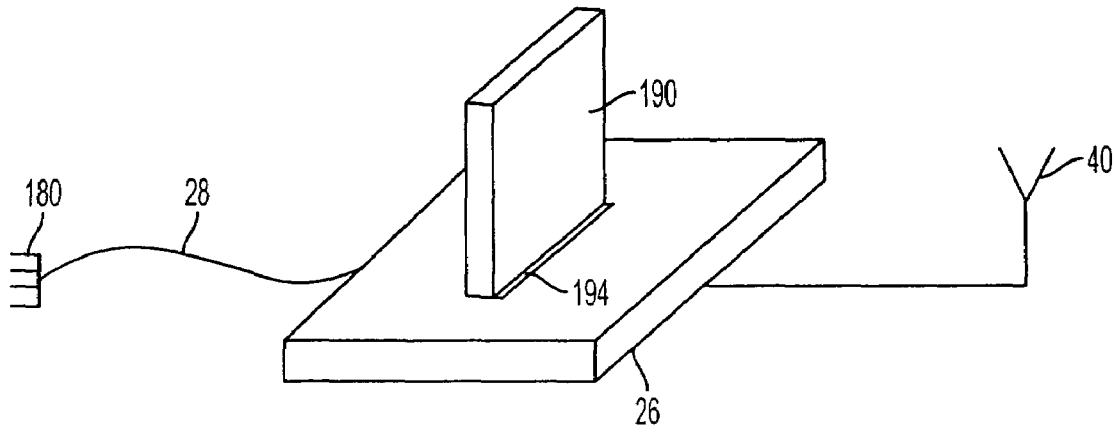
Figure 11:
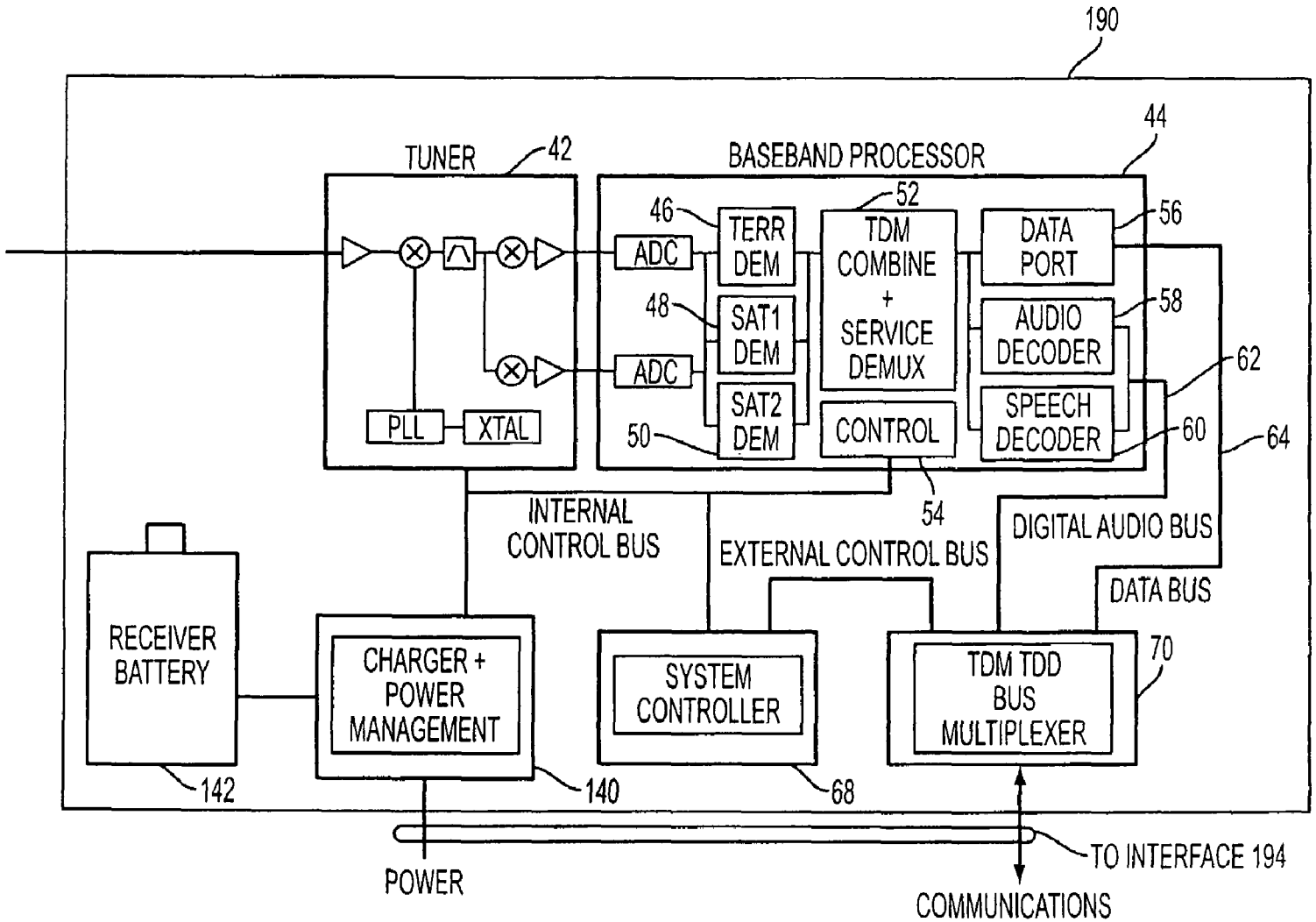
FIG. 11 is a block diagram of the SDARS subscription cartridge of FIGS. 10A and 10B.
Figure 13A:
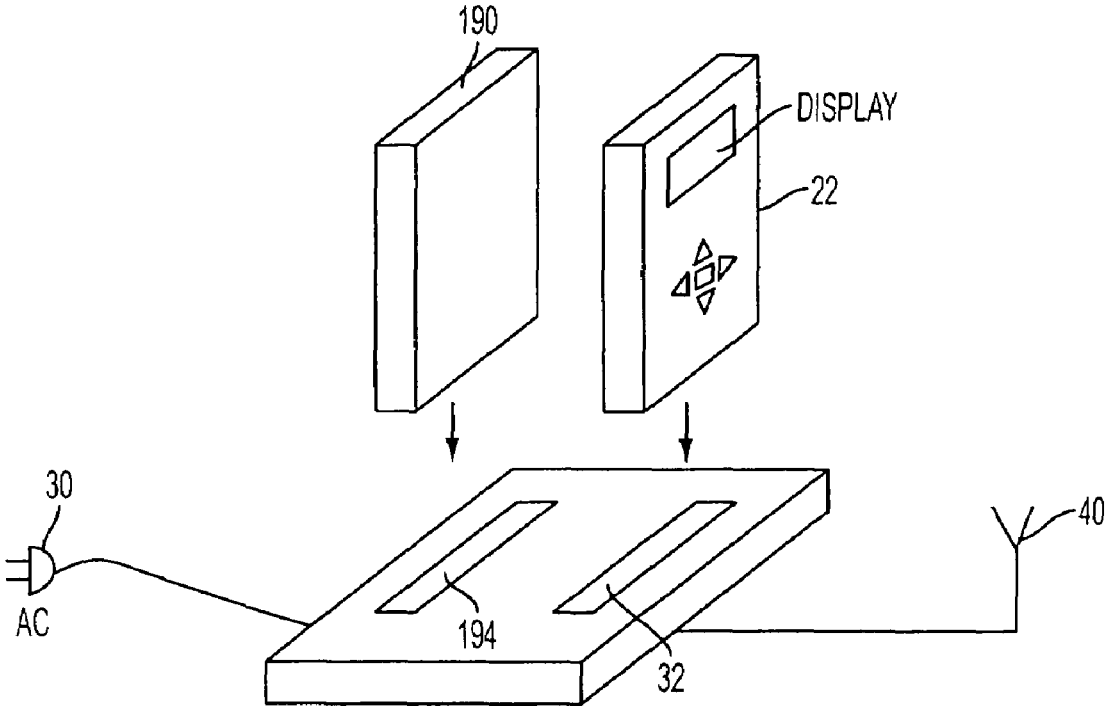
FIGS. 13A and 13B depict a docking system with SDARS subscription cartridge and media player in accordance with an embodiment of the present invention.
Figure 13B:
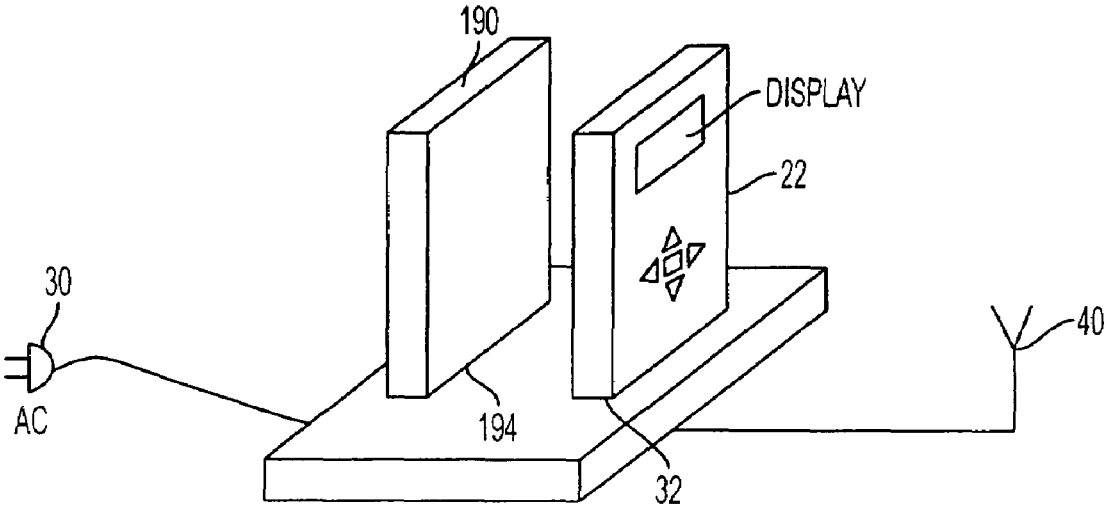

With reference to FIGS. 10A and 10B, a docking system with SDARS subscription cartridge 190 is provided in accordance with another exemplary embodiment of the present invention. The docking station 26' can be connected to a standard SDARS antenna 40, as opposed to the digital antenna 178 or integrated antenna 24 comprising an SDARS receiver and antenna in a single unit. The docking station can be connected to an SDARS-compatible device 152 via a cable 28 and connector 180, as described above in connection with FIGS. 8A and 8B. The docking station comprises an interface or connector 194 for detachably connecting to a cartridge 194 and/or a portable media player 22 (as shown in FIGS. 13A and 13B). As shown in FIG. 11, the cartridge 190 comprises essentially all of the components described above in connection with FIG. 6, except for the battery 142, the charger and power management device 140 and the antenna 40. The description of the remaining components is therefore omitted here for conciseness.

Figure 12:
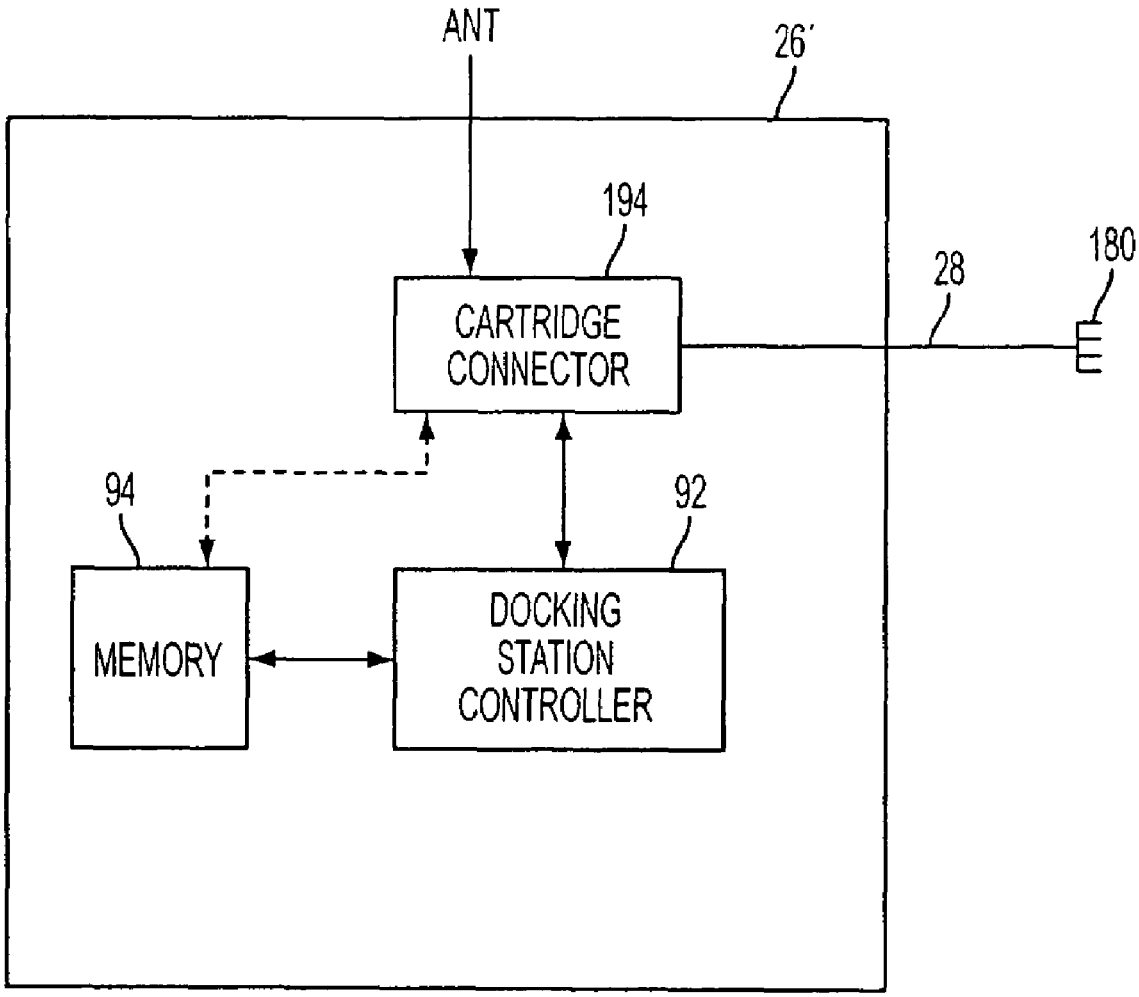
FIG. 12 is a block diagram of a docking station for use with the docking system with SDARS subscription cartridge configuration illustrated in FIGS. 10A and 10B.

The docking station 26' (FIG. 12) for the configuration depicted in FIGS. 10A and 10B can comprise, for example, a cartridge connector 194 for electrically coupling the cartridge 190 to the docking station 26' controller 92 and optionally the memory 94, as well as to a player 22 or other device 152 via the cable 28. An antenna 40 input comprising an SDARS stream is provided to the connector 194 and, in turn, to the cartridge 190. Power can be provided to the docking station 26' and the cartridge 190 from the player 22 or other device 152 via the cable 28 as described above.

Figure 14:
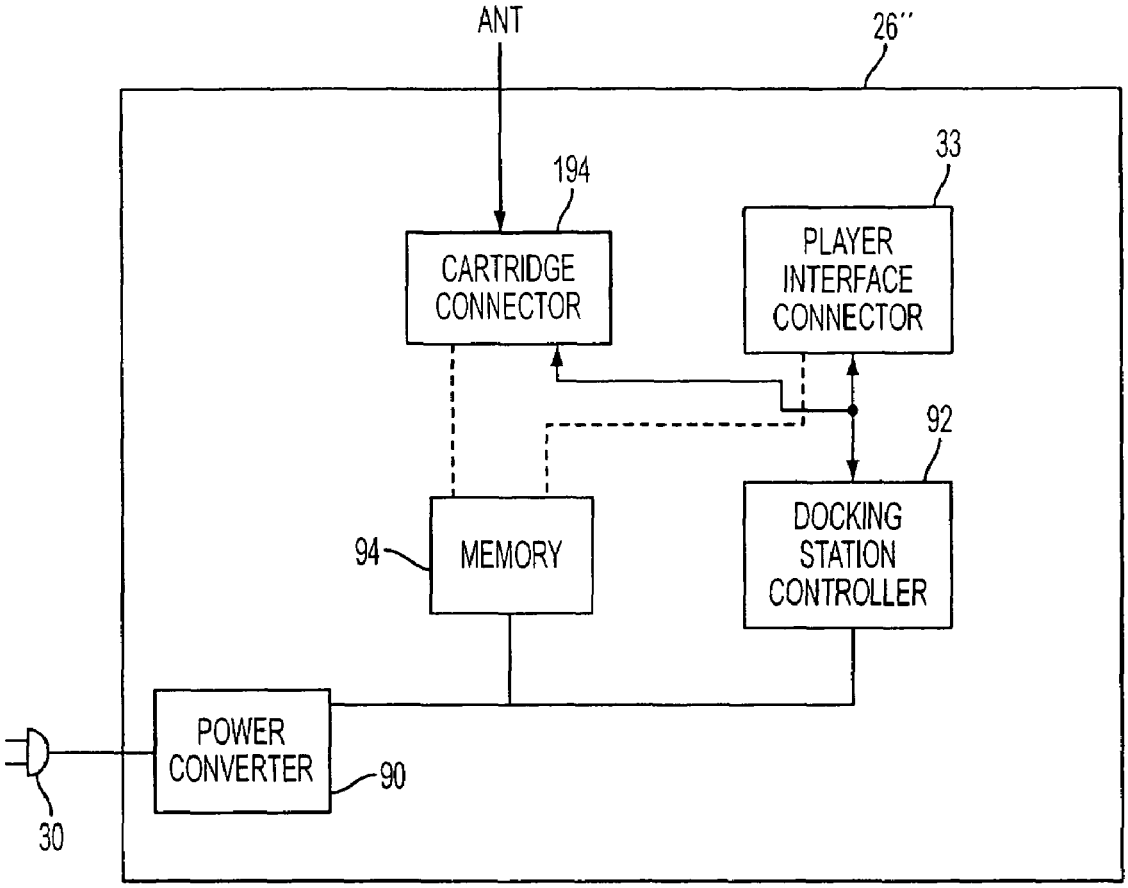
FIG. 14 is a block diagram of a docking station for use with the docking system with SDARS subscription cartridge and media player configuration illustrated in FIGS. 13A and 13B.

The docking station 26" (FIG. 14) for the configuration depicted in FIGS. 13A and 13B can comprise, for example, a cartridge connector 194 for electrically coupling the cartridge 190 to the docking station 26" controller 92 and optionally the memory 94, and a player interface connector 33. An antenna 40 input comprising an SDARS stream is provided to the connector 194 and, in turn, to the cartridge 190. Power can be provided, for example, to the docking station 26", the cartridge 190, and the player via an external power source.

Although the present invention has been described with reference to a preferred embodiment thereof, it will be understood that the invention is not limited to the details thereof. Various modifications and substitutions have been suggested in the foregoing description, and others will occur to those of ordinary skill in the art. All such substitutions are intended to be embraced within the scope of the invention as defined in the appended claims.

What is claimed is:

1. A satellite digital audio radio service (SDARS) receiver and digital media player system comprising:

a portable digital media player having a first communication interface, a memory device, a controller, a user interface and a first connector; and a portable SDARS receiver module having a second connector configured to detachably and electrically connect to the player via the first connector, an antenna, an SDARS tuner and a baseband processing device for receiving an SDARS signal and recovering program channels therefrom, and a second communication interface;

wherein, when the player and the SDARS receiver module are connected together, the player and the SDARS receiver module transmit and receive signals between each other via the first communication interface and the second communication interface, the signals comprising at least one of control signals and at least part of the SDARS signal;

wherein the control signals comprise signals from the portable digital media player to select from among the program channels that are transmitted to the SDARS receiver module in response to user input signals from the user interface, and the at least part of the SDARS signal comprises the selected program channels recovered by the SDARS receiver module and transmitted to that player; and wherein the controller is operable to store at least the selected program channels in the memory device for playback via the player when the player is not connected to the SDARS receiver module and when the antenna is not able to receive the SDARS signal, and the controller is operable to playback the SDARS signal as it is being received via the SDARS receiver module when the player is connected to the SDARS receiver module.

2. An SDARS receiver and digital media player system as claimed in claim 1, wherein the first communication interface and the second communication interface are each operable to transmit and receive bi-directional serial communication signals.

3. An SDARS receiver and digital media player system as claimed in claim 1, wherein the first communication interface and the second communication interface each comprise a bus multiplexer.

4. An SDARS receiver and digital media player system as claimed in claim 1, wherein the SDARS receiver module comprises a battery to provide power to the antenna, the SDARS tuner and the baseband processing device for portable reception of the SDARS signal.

5. An SDARS receiver and digital media player system as claimed in claim 4, wherein the player is provided with a smaller battery than the battery in the SDARS receiver module to minimize the player's form factor.

6. An SDARS receiver and digital media player system as claimed in claim 1, wherein the SDARS receiver module is operable to translate a compressed SDARS signal to one of an uncompressed format and a different compressed format depending on the player's requirements for playback.

7. A portable media player comprising:

an interface to a satellite digital audio radio service (SDARS) reception device to allow communication between the media player and the SDARS reception device;

a user interface for selecting among a plurality of SDARS channels received via the SDARS reception device;

a controller; and a memory device;

wherein the controller is programmable to send control signals to the SDARS reception device, when the SDARS reception device is connected to the media player via the interface, to command the SDARS reception device to send selected ones of the plurality of SDARS channels for storage in the memory device, the controller being programmable to playback selected ones of the plurality of SDARS channels from the memory device when the SDARS reception device is not connected to the media player.

8. A portable media player as claimed in claim 7, wherein the interface is an electrical connector adapted to receive a corresponding electrical connector on the SDARS reception device.

9. A portable media player as claimed in claim 7, wherein the media player and the SDARS reception device each comprise a housing configured to detachably abut the other housing to create a combined media player and SDARS reception device unit.

10. A satellite digital audio radio service (SDARS) receiver system comprising:

a docking station comprising a player interface configured to detachably connect a portable digital media player to the docking station, the portable digital media player having a first transceiver interface;

an integrated SDARS antenna connected to the docking station, the integrated SDARS antenna comprising an antenna, an SDARS tuner and baseband processing device for receiving an SDARS signal and recovering program channels therefrom, and a second transceiver interface; and a conductor electrically connecting the docking station and the integrated SDARS antenna via the first transceiver interface and the second transceiver interface, respectively;

wherein control signals from the portable digital media player to select from among the program channels are provided to the integrated SDARS antenna via the conductor, and the selected program channels recovered by the integrated SDARS antenna are provided to the portable digital media player via the conductor.

11. A SDARS receiver system as claimed in claim 10, wherein the integrated SDARS antenna is operable to transmit at least one of data and digital audio recovered from the SDARS signal via the baseband processing device to the portable digital media player via the conductor.

12. A SDARS receiver system as claimed in claim 10, wherein the first transceiver interface and the second transceiver interface are configured to perform bidirectional, multiplexed communication via the conductor.

13. A SDARS receiver system as claimed in claim 10, wherein the conductor is a serial bus.

14. A SDARS receiver system as claimed in claim 10, wherein the conductor employs two-wire differential communications.

15. A SDARS receiver system as claimed in claim 10, wherein the docking station is connected to a power source and configured to provide power to the conductor, the conductor further comprising two power lines to supply power to the integrated SDARS antenna from the docking station.

16. A SDARS receiver system as claimed in claim 10, wherein the docking station is connected to a power source, and the conductor comprises power and ground conductors for supplying power from the docking station to the integrated SDARS antenna, and first and second communication conductors for providing bidirectional communication between the docking station to the integrated SDARS antenna.

17. A SDARS receiver system as claimed in claim 10, further comprising a memory device in the SDARS receiver, the SDARS receiver being operable to store at least part of the SDARS signal when the media player is detached from the docking station and SDARS receiver.

18. A SDARS receiver system as claimed in claim 10, wherein the SDARS receiver and the media player each comprise a memory interface for a removable storage device, the SDARS receiver being operable to store at least part of the SDARS signal in the removable storage device when it is connected to the memory interface of the SDARS receiver, and the media player is operable to play back the stored SDARS signal in the removable storage device when it is connected to the memory interface of the media player.

19. A SDARS receiver system as claimed in claim 18, wherein the media player is operable to play back the stored SDARS signal in the removable storage device when it is connected to the memory interface of the media player when the media player is detached from the docking station and SDARS receiver.

20. A digital antenna module for providing satellite digital audio radio service (SDARS) to an SDARS-compatible playback device comprising:

an antenna for receiving an SDARS signal;

an SDARS receiver module comprising an SDARS tuner and a baseband processing device for processing the SDARS signal and recovering program channels therefrom; and a communication interface for connecting to the SDARS-compatible playback device, the SDARS-compatible playback device having a corresponding communication interface;

wherein, when the digital antenna module and the SDARS-compatible playback device are connected together, the digital antenna module and the SDARS-compatible playback device transmit and receive signals between each other via their respective communication interfaces, the signals comprising at least one of control signals and at least part of the SDARS signal;

wherein the control signals comprise signals from the SDARS-compatible playback device to select from among the program channels that are transmitted to the digital antenna module in response to user input signals provided to the SDARS-compatible playback device, and the at least part of the SDARS signal comprises the selected program channels recovered by the digital antenna module and transmitted to the SDARS-compatible playback device.

21. A digital antenna as claimed in claim 20, wherein the digital antenna module is operable to transmit at least one of data and digital audio recovered from the SDARS signal via the baseband processing device to the SDARS-compatible playback device via the respective communication interfaces.

22. A digital antenna as claimed in claim 20, wherein the respective communication interfaces are configured to perform bidirectional, multiplexed communication.

23. A digital antenna as claimed in claim 20, wherein the respective communication interfaces provide a serial bus between the digital antenna module and the SDARS-compatible playback device.

24. A digital antenna as claimed in claim 20, wherein the respective communication interfaces employ two-wire differential communications.

25. A digital antenna as claimed in claim 20, wherein the SDARS-compatible playback device is connected to a power source, and further comprising a conductor connecting the digital antenna module and the SDARS-compatible playback device, the conductor comprising a serial bus for connecting the respective communication interfaces to each other, and two power lines to supply power to the digital antenna module from the SDARS-compatible playback device.

26. A digital antenna as claimed in claim 20, wherein the SDARS-compatible playback device comprises a four-line connector adapter to receive two communication lines extending from the digital antenna module and two power lines, the power lines supplying power to the digital antenna module from the SDARS-compatible playback device, the two communication lines providing two-wire differential communication.

27. A digital antenna as claimed in claim 20, wherein the two communication lines and the respective communication interfaces are configured to provide time division multiplexing, time division duplexing between the digital antenna module and the SDARS-compatible playback device.

28. A satellite digital audio radio service (SDARS) receiver system comprising:

a docking station comprising a player interface configured to detachably connect a portable digital media player to the docking station, the portable digital media player having a first transceiver interface;

an integrated SDARS antenna connected to the docking station, the integrated SDARS antenna comprising an antenna, an SDARS tuner and baseband processing device for receiving an SDARS signal and recovering program channels therefrom, and a second transceiver interface; and a conductor electrically connecting the docking station and the integrated SDARS antenna via the first transceiver interface and the second transceiver interface, respectively;

wherein control signals from the portable digital media player to select from among the program channels are provided to the integrated SDARS antenna via the conductor, and the selected program channels recovered by the integrated SDARS antenna are provided to the portable digital media player via the conductor.

29. A satellite digital audio radio service (SDARS) receiver system comprising:

an integrated SDARS antenna module comprising an antenna, an SDARS tuner and a baseband processing device for receiving an SDARS signal and recovering program channels therefrom; and a first connector for electrically coupling the integrated SDARS antenna module to external devices having a second connector compatible with the first connector; and a controller programmable to provide selected ones of the recovered program channels to the first connector in response to control signal received via the second connector;

wherein the integrated SDARS antenna module and controller are provided in a cartridge comprising a unitary housing with the first connector configured on the exterior thereof and accessible to the second connector; and wherein the SDARS receiver system is assigned an identifier and requires activation before the integrated SDARS antenna module can provide SDARS signals to the first connector, the controller being operable to maintain activation of the SDARS receiver system when the cartridge is connected to any of the external devices.

* * * * *

UNITED STATES PATENT AND TRADEMARK OFFICE

CERTIFICATE OF CORRECTION

PATENT NO. : 7,606,526 B2
APPLICATION NO. : 11/239642
DATED : October 20, 2009
INVENTOR(S) : Patsiokas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 902 days.

Signed and Sealed this

Twelfth Day of October, 2010

David J. Kappos

David J. Kappos
*Director of the United States Patent and Trademark Office*